US012631199B2

(12) United States Patent
Patel et al.

(10) Patent No.: US 12,631,199 B2
(45) Date of Patent: May 19, 2026

(54) BLOWER ASSEMBLY ENCLOSURE

(71) Applicant: Regal Beloit America, Inc., Beloit, WI (US)

(72) Inventors: Chirag Sureshbhai Patel, Rogers, AR (US); Michael D. Smith, Rogers, AR (US); Steven A. Trimble, Cassville, MO (US); Surya Madugula, Hyderabad (IN); SaiGeetha Padiri, Hyderabad (IN); Jeffrey C. Hutson, Cassville, MO (US); Cameron Perini, Bentonville, AR (US); Mitchell McDonald, Rogers, AR (US); Griffin Roach, Rogers, AR (US); Abhishek Sharma, Cassville, MO (US)

(73) Assignee: Regal Beloit America, Inc., Milwaukee, WI (US)

( * ) Notice: Subject to any disclaimer, the term of this patent is extended or adjusted under 35 U.S.C. 154(b) by 54 days.

(21) Appl. No.: 18/460,331

(22) Filed: Sep. 1, 2023

(65) Prior Publication Data

US 2025/0075708 A1 Mar. 6, 2025

(51) Int. Cl.
*F04D 17/08* (2006.01)
*F04D 29/42* (2006.01)
(Continued)

(52) U.S. Cl.
CPC ..... *F04D 29/701* (2013.01); *F04D 17/08* (2013.01); *F04D 29/4206* (2013.01); *F04D 29/441* (2013.01)

(58) Field of Classification Search
CPC ..... F04D 29/4206; F04D 29/4213; F04D 29/426; F04D 29/441; F04D 29/701; F04D 29/5826; F04D 17/08; F04D 17/16; F24H 4/00; F24H 4/02; F24H 4/04; H05B 1/0283
(Continued)

(56) References Cited

U.S. PATENT DOCUMENTS 5,088,886 A * 2/1992 Hopkins ..... F04D 29/667 415/206
6,908,281 B2 6/2005 Lyons et al.
(Continued)

FOREIGN PATENT DOCUMENTS

EP 4063759 A1 9/2022
WO 2023137173 A1 7/2023

*Primary Examiner* — Nathaniel E Wiehe
*Assistant Examiner* — Justin A Pruitt
(74) *Attorney, Agent, or Firm* — Armstrong Teasdale LLP

(57) ABSTRACT

An air transferring system is disclosed. The air transferring system includes an enclosure, a faceplate, and a blower assembly attached to the faceplate. The enclosure includes a base, a lid having an air exhaust, and a shroud. The shroud has an open shroud top, an open shroud bottom, and an opening in the shroud defined between a first shroud edge and a second shroud edge. Each of the shroud edges extends between the open shroud top and the shroud bottom. The faceplate includes a faceplate opening that extends between the first and second shroud edges. The blower assembly includes a blower exhaust proximate to all of the faceplate opening, an exhaust opening, and an impeller for drawing air through the air exhaust, faceplate opening, and blower exhaust and urging the air out the exhaust.

19 Claims, 12 Drawing Sheets

(51) Int. Cl.
*F04D 29/44* (2006.01)
*F04D 29/70* (2006.01)

(58) Field of Classification Search
USPC ..... 415/203; 122/13.01, 19.2
See application file for complete search history.

(56) References Cited

U.S. PATENT DOCUMENTS

| | | | | |
|---|---|---|---|---|
| 7,861,708 | B1 * | 1/2011 | Lyons | F04D 29/668 415/206 |
| 10,041,619 | B2 * | 8/2018 | Edmonds | F24F 1/40 |
| 10,718,549 | B2 * | 7/2020 | Pugh | F25B 30/02 |
| 2008/0203866 | A1 * | 8/2008 | Chamberlain | F24F 1/0063 312/236 |
| 2012/0131944 | A1 | 5/2012 | Havard, Jr. et al. | |
| 2019/0173140 | A1 * | 6/2019 | Yokote | F04D 29/661 |

* cited by examiner

BLOWER ASSEMBLY ENCLOSURE

BACKGROUND

The field of the disclosure relates generally to blower assembly enclosures, and more particularly, to commercial and residential heat pump water heater blower assembly enclosures.

Heat pump water heaters in commercial and residential applications utilize a condenser coil to extract heat from a heat-pump cycle system and transfer the heat to the water inside the tank. An axial fan is positioned at the coil such that ambient air is pushed through the coil and subsequently directed into HVAC (heating ventilation and air cooling) ducting. The cooled air may then be circulated in the ambient atmosphere or the surrounding space. The heat-pump system, the coil, and the axial fan are commonly placed within an enclosure having a base, a shroud, and a lid. The base has a surface area that is sized to fit over a top surface of a water tank.

Due to safety regulations, fan blades of the axial fan need to be fully enclosed. Wrap-around sheet-metal shrouds are often used to fully enclose the axial fan and other components of the water heater. Handling the flexible sheet metal composing the shrouds makes servicing of the water heater difficult. By way of example, to service the motor of the axial fan, the lid must first be removed prior to removing the shroud. Additionally, fluid or air conduits that extend through the lid may also need to be disconnected. The size of the axial fan however is limited by the size of the enclosure and the size of the base.

Therefore, there is a need to provide a heat pump enclosure that is easier to disassemble, and enables access to fan components within the enclosure.

BRIEF DESCRIPTION

In one aspect of the present disclosure, an air transferring system is disclosed. The air transferring system includes an enclosure, a faceplate, and a blower assembly attached to the faceplate. The enclosure includes a base, a lid having an air exhaust, and a shroud. The shroud has an open shroud top, an open shroud bottom, and an opening in the shroud defined between a first shroud edge and a second shroud edge. Each of the shroud edges extends between the open shroud top and the shroud bottom. The faceplate includes a faceplate opening which extends between the first and second shroud edges. The blower assembly includes a blower exhaust proximate to all of the faceplate opening, an exhaust opening, and an impeller for drawing air through the air exhaust, faceplate opening, and blower exhaust and urging the air out the exhaust.

In another aspect of the present disclosure, a method of assembling an air transferring system is disclosed. The method includes providing a circular base having a top surface and attaching a shroud on the top surface of the base. The shroud has an open shroud top, an open shroud bottom, and an opening in the shroud defined between a first shroud edge and a second shroud edge. Each of the shroud edges extends between the open shroud top and the shroud bottom. The method further includes attaching a faceplate between the first and second shroud edges. The faceplate includes an external mounting surface and an opening. The method further includes attaching a blower assembly to the external mounting surface faceplate. The blower assembly includes a blower exhaust proximate to all of the faceplate opening, an exhaust opening, and an impeller for drawing air through the air exhaust, faceplate opening, and blower exhaust and urging the air out the blower exhaust.

BRIEF DESCRIPTION OF THE DRAWINGS

The reference symbols used in the drawings, and their meanings, are listed in summary form in the list of reference symbols. In principle, identical parts are provided with the same reference symbols in the figures.

DETAILED DESCRIPTION

In the following specification and the claims, reference will be made to a number of terms, which shall be defined to have the following meanings.

As used herein, the singular forms "a," "an," and "the" include plural references unless the context clearly dictates otherwise. The terms "comprising," "including," and "having" are intended to be inclusive and mean that there may be additional elements other than the listed elements. The terms "optional" or "optionally" mean that the subsequently described event or circumstance may or may not occur, and that the description includes instances where the event occurs and instances where it does not.

Embodiments of the present disclosure are directed to an air transferring system. The air transferring system includes an enclosure, a faceplate, and a blower assembly attached to the faceplate. The enclosure includes a base, a lid having an air exhaust, and a shroud. The shroud has an open shroud top, an open shroud bottom, and an opening in the shroud defined between a first shroud edge and a second shroud edge. Each of the shroud edges extends between the open shroud top and the shroud bottom. The faceplate includes a faceplate opening that extends between the first and second shroud edges. The blower assembly includes a blower exhaust proximate to all of the faceplate opening, an exhaust opening, and an impeller for drawing air through the air exhaust, faceplate opening, and blower exhaust and urging the air out the exhaust. The shroud comprises a rounded shroud body enclosing a heat pump or, more generally, components of a heat pump. The blower is external to the shroud such that the blower assembly is accessible for service and maintenance.

Figure 1:
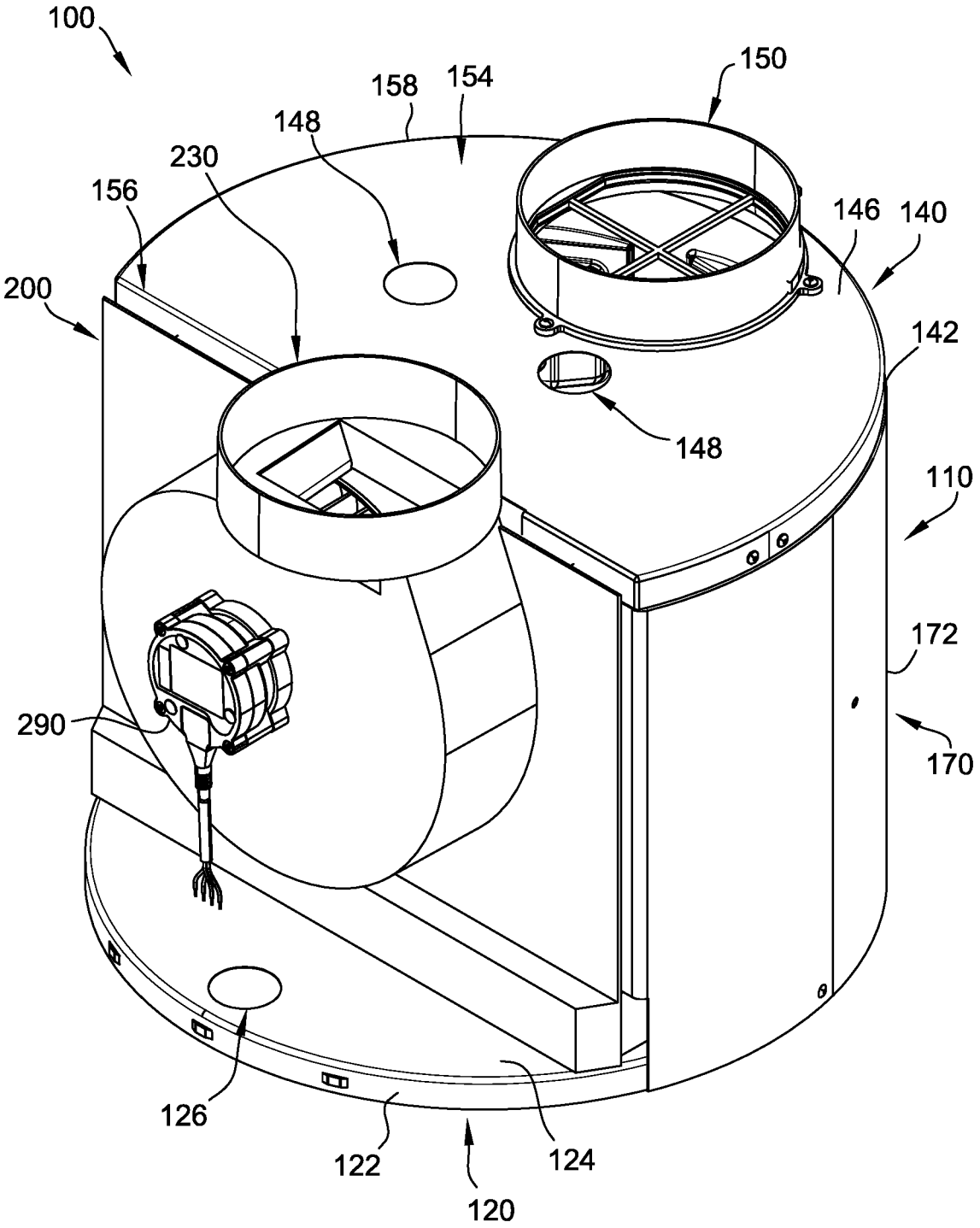
FIG. 1 illustrates a perspective view of an air transferring system in accordance with one or more embodiments of the present disclosure.
Figure 2:
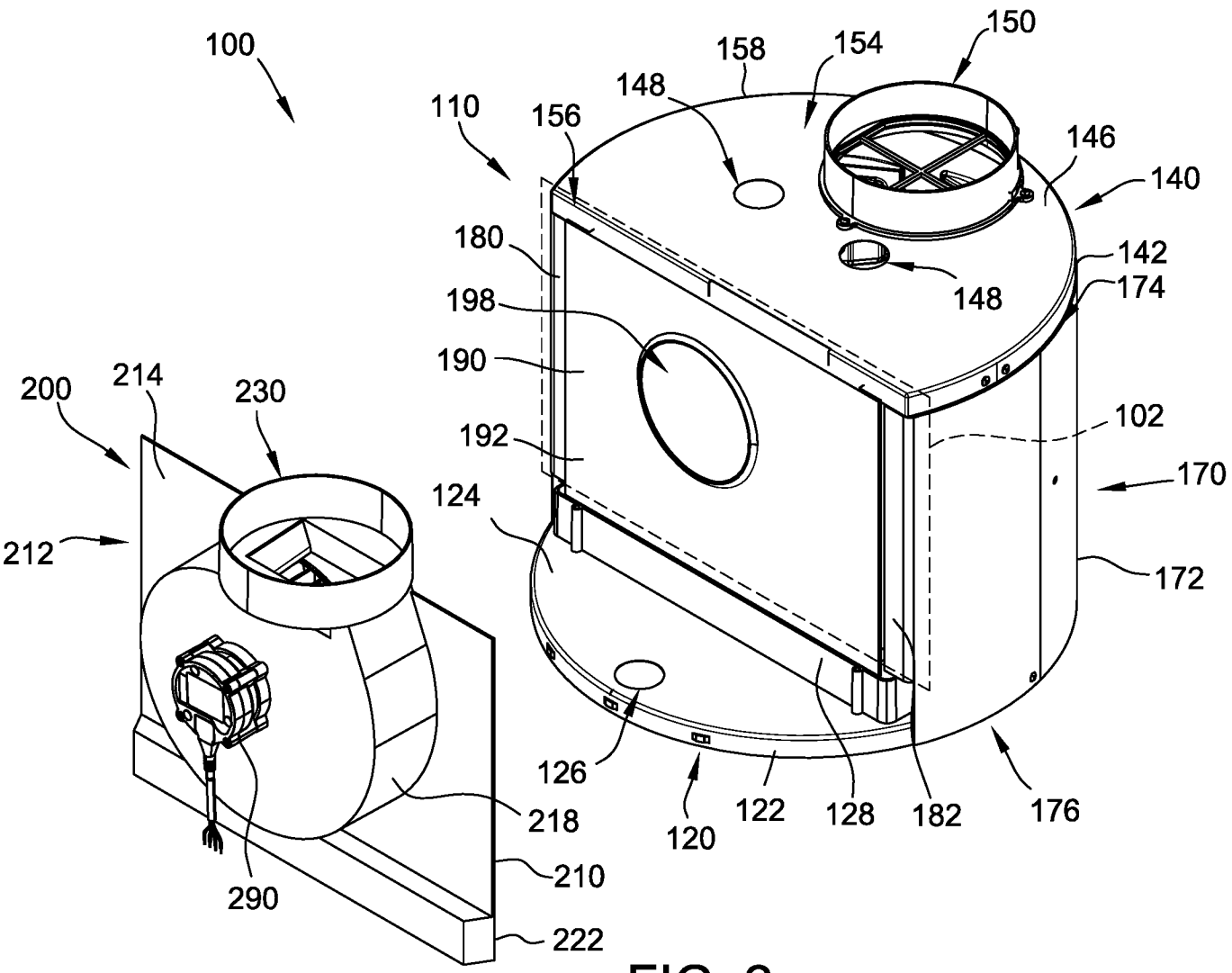
FIG. 2 illustrates a perspective view of a blower assembly removed from an enclosure of the air transferring system shown in FIG. 1.
Figure 3:
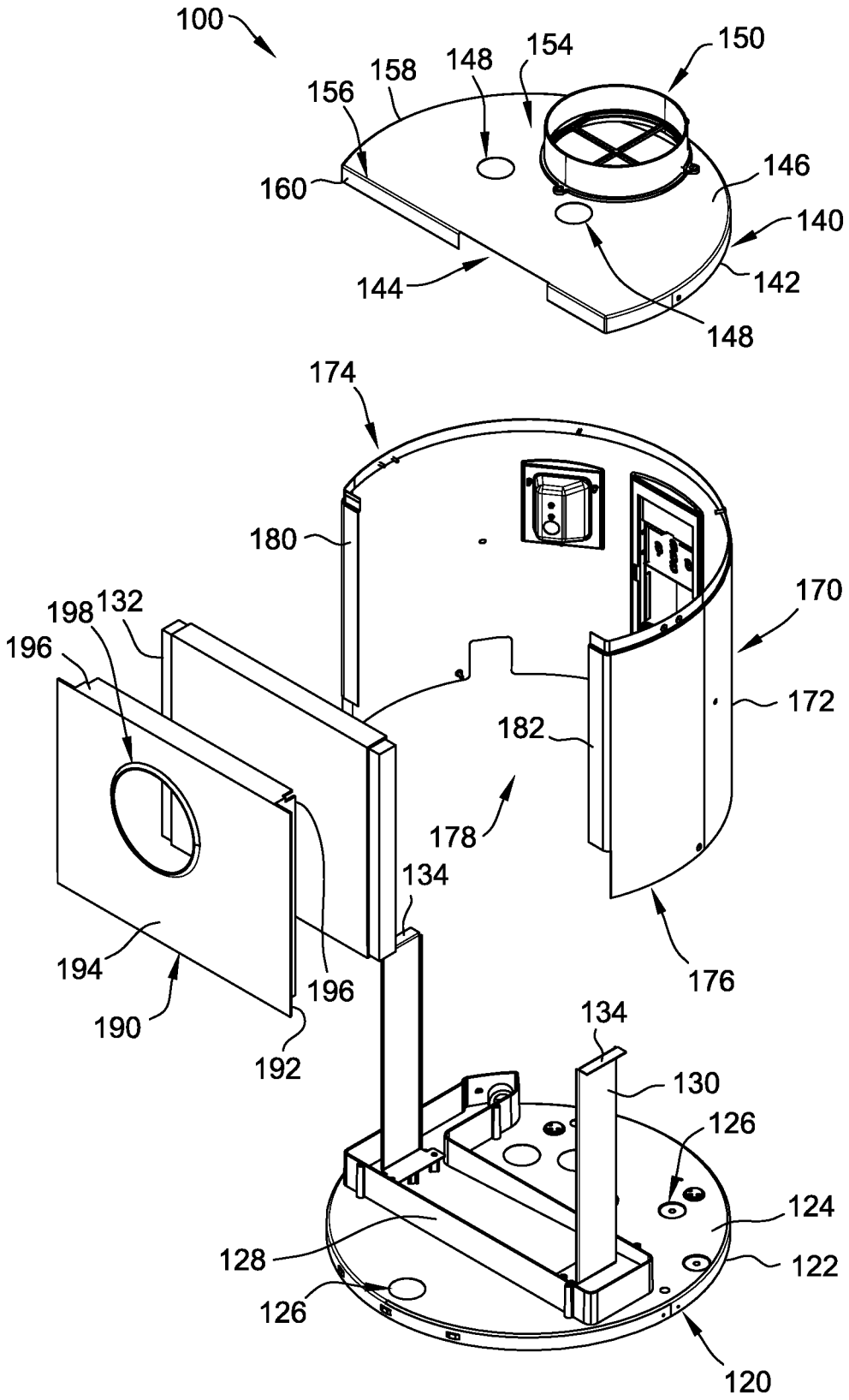
FIG. 3 illustrates an exploded view of the enclosure shown in FIG. 2.

FIG. 1 illustrates a perspective view of an air transferring system 100 in accordance with one or more embodiments of the present disclosure. The air transferring system 100 includes an enclosure 110 having a base 120, a lid 140, and a shroud 170. The air transferring system 100 further includes a faceplate 190, and a blower assembly 200 attached to the faceplate 190. Faceplate 190 is identified specifically in FIGS. 2-4. FIG. 2 illustrates a perspective view of the air transferring system 100 with the blower assembly 200 removed from the faceplate 190. FIG. 3 illustrates an exploded view of the air transferring system 100. Components of the enclosure 110, including the base 120, lid 140, and shroud 170, and in some embodiments, the faceplate 190 and components of the blower assembly 200, are generally formed from stamped sheet metal. Stamping or metal pressing processes include bending, flanging, and/or punching of shapes into the sheet metal by use of specialized dies and brakes. By way of example, the shroud 170 may be formed by a combination of metal rolling and bending. Components may be assembled together by flanging, welding, fastening, and/or by interference fits where applicable.

With reference to FIGS. 1 through 3, the base 120 has a circular base body 122 having a top surface 124. In some embodiments, the base body 122 includes openings 126 through which fluid conduits or electrical conduits may pass. In some embodiments, the base body 122 includes a drain pan 128 for collecting condensation formed on surfaces of the enclosure 110. In some embodiments, a evaporator or a heat exchanger bracket 130 extends from the top surface 124 of the base body 122. The bracket 130 is configured to hold an evaporator or heat exchanger 132. In some embodiments, top ends 134 of the bracket 130 are flat such that the top ends 134 can be attached to the lid 140.

The lid 140 has a lid body 142 having a bottom surface 144 and a top surface 146. In some embodiments, the lid body 142 includes openings 148 through which fluid conduits or electrical conduits may pass. The lid body 142 further includes an air conduit opening 150 configured as a system inlet. The lid body 142 comprises a rounded configuration 154 and a straight edge portion 156. The lid body 142 includes a peripheral sidewall 158 surrounding the rounded configuration 154 and the straight edge portion 156. The peripheral sidewall 158 at the straight edge portion 156 defines a straight edge surface 160 (as best shown in FIG. 3). In some embodiments, the peripheral sidewall 158 and the straight edge surface 160 are folded or otherwise bent such that the peripheral sidewall 158 and the straight edge surface 160 are perpendicular to the bottom surface 144.

The shroud 170 has a curved elongate body 172 having an open shroud top 174 and an open shroud bottom 176. The curved elongate body 172 forms an opening 178 (as best shown in FIG. 3) between the open shroud top 174 and the open shroud bottom 176. The shroud 170 is substantially semi-circular such that a first shroud edge 180 and a second shroud edge 182 extend between the open shroud top 174 and the open shroud bottom 176, and such that the first shroud edge 180 and the second shroud edge 182 oppose one another and are co-planar. In some embodiments, the curve of the elongate body 172 is formed by metal roll bending, and the first shroud edge 180 and the second shroud edge 182 are folded or otherwise bent such that the first shroud edge 180 and the second shroud edge 182 are co-planar.

As best shown in FIG. 3, the faceplate 190 includes a first surface 192 and a second surface 194 opposite the first surface 192. In some embodiments, the first surface 192 includes tabs 196 which are configured to hold the air evaporator or heat exchanger 132 and fit between the bracket 130. In some embodiments, the faceplate 190 includes an air opening 198 through which air passes, as explained in further detail below.

As shown in FIG. 2, the open shroud bottom 176 of the shroud 170 is removably affixed to the top surface 124 of the base 120 such that the co-planar first shroud edge 180 and the second shroud edge 182 are substantially aligned and co-planar with the drain pan 128 of the base 120. The bottom surface 144 of the lid 140 is removably affixed to the open shroud top 174 of the shroud 170; the bottom surface 144 is identified specifically in FIG. 3. As shown in FIG. 2, the rounded configuration 154 of the lid 140 has the same configuration as the shroud 170 such that they enclose the assembly. The straight edge portion 156 of the lid 140 and the first shroud edge 180 and the second shroud edge 182 of the shroud 170 are substantially co-planar and define a mounting plane 102. In some embodiments, the drain pan 128 and the first surface 192 of the faceplate 190 are also co-planar with the straight edge portion 156 of the lid 140 and the first shroud edge 180 and the second shroud edge 182 of the shroud 170. As explained in further detail below, the blower assembly 200 is positioned against the mounting plane 102 such that the blower assembly 200 is attached to at least the faceplate 190.

Figure 4:
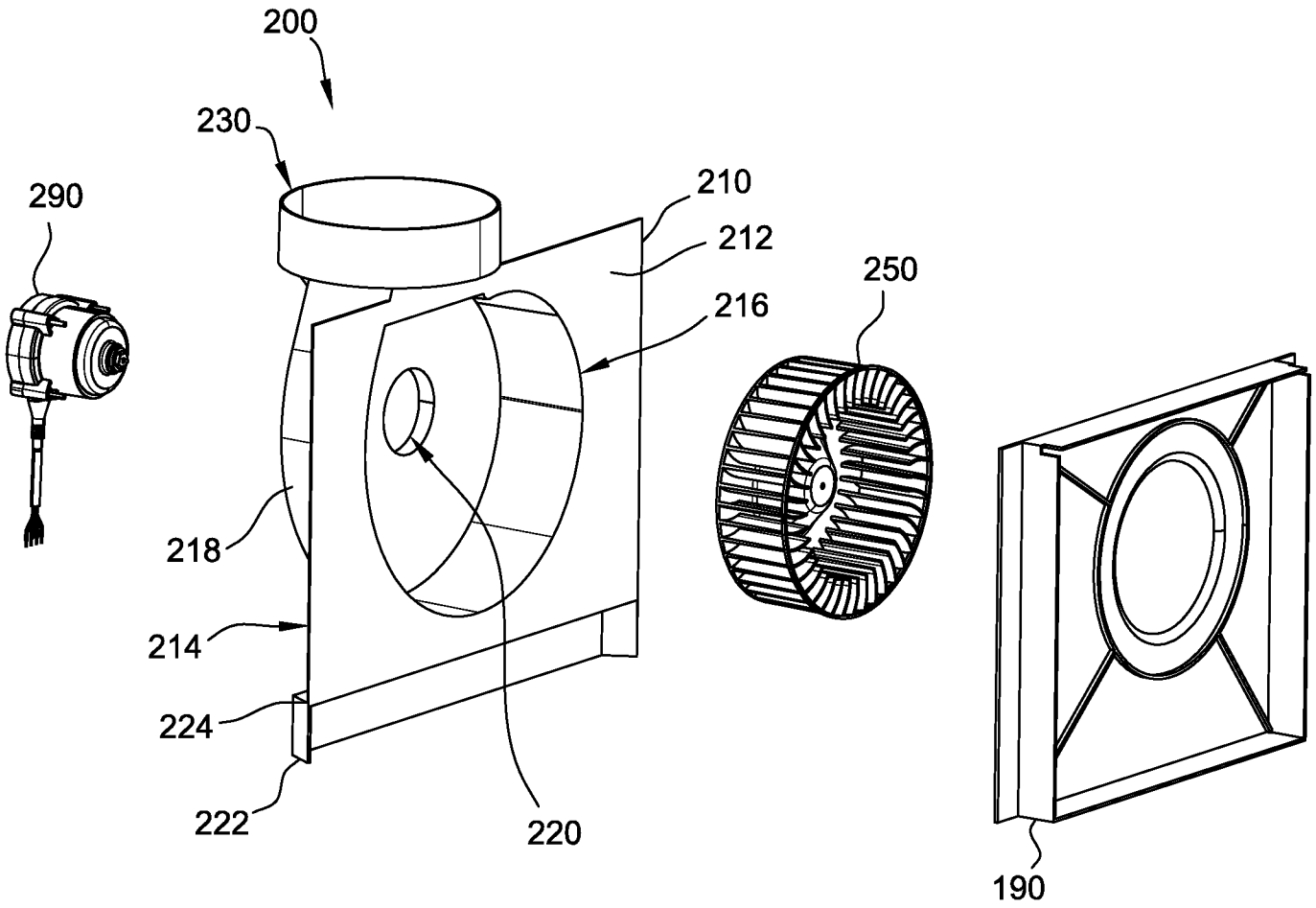
FIG. 4 illustrates an exploded view of the blower assembly shown in FIG. 2.

FIG. 4 illustrates an exploded view of the blower assembly 200 in accordance with an embodiment of the present disclosure. With reference to FIGS. 2 and 4, the blower assembly 200 includes a blower housing 210, a centrifugal impeller 250, and a motor 290. The blower housing 210 includes a first surface 212 and a second surface 214. The blower housing 210 also includes a blower cavity 216 defined by at least one sidewall 218 extending from the second surface 214. The blower cavity 216 is sized and configured to house the impeller 250. The blower cavity 216 further includes an opening 220 through which a shaft (not shown) of the motor 290 passes and couples to the impeller 250. A blower exhaust 230 extends from the at least one sidewall 218 and in some embodiments is substantially tangential to the at least one sidewall 218. The motor 290 is positioned on an outer surface of the at least one sidewall 218.

The blower housing 210 is attached to the faceplate 190 when the blower assembly 200 is assembled for use in the air transferring system 100. The impeller 250 is configured to draw air from the air conduit opening 150 of the lid 140 and circulate the air within the enclosure 110. Air is subsequently drawn through the air opening 198 of the faceplate 190 and out from the blower exhaust 230 of the blower assembly 200. Air opening 198 is identified specifically in FIG. 3.

In some embodiments, the blower housing 210 further includes a bottom cover 222 disposed along a bottom edge 224 of the blower housing 210. The bottom cover 222 protrudes from the second surface 214 such that the drain pan 128 is covered by the blower housing 210 when the blower assembly 200 is affixed to the faceplate 190.

The use of the centrifugal impeller 250 instead of an axial fan allows for the entire blower assembly 200 to be external relative to the enclosure 110 and the shroud 170. This allows for the blower assembly 200 to be accessed and serviced without having to remove the shroud 170. Additionally, positioning the motor 290 external to the enclosure 110, shroud 170, and the blower housing 210 allows for the motor 290 to be accessed and serviced without having to remove the shroud 170, the blower housing 210, and the blower assembly 200 generally.

Figure 5:
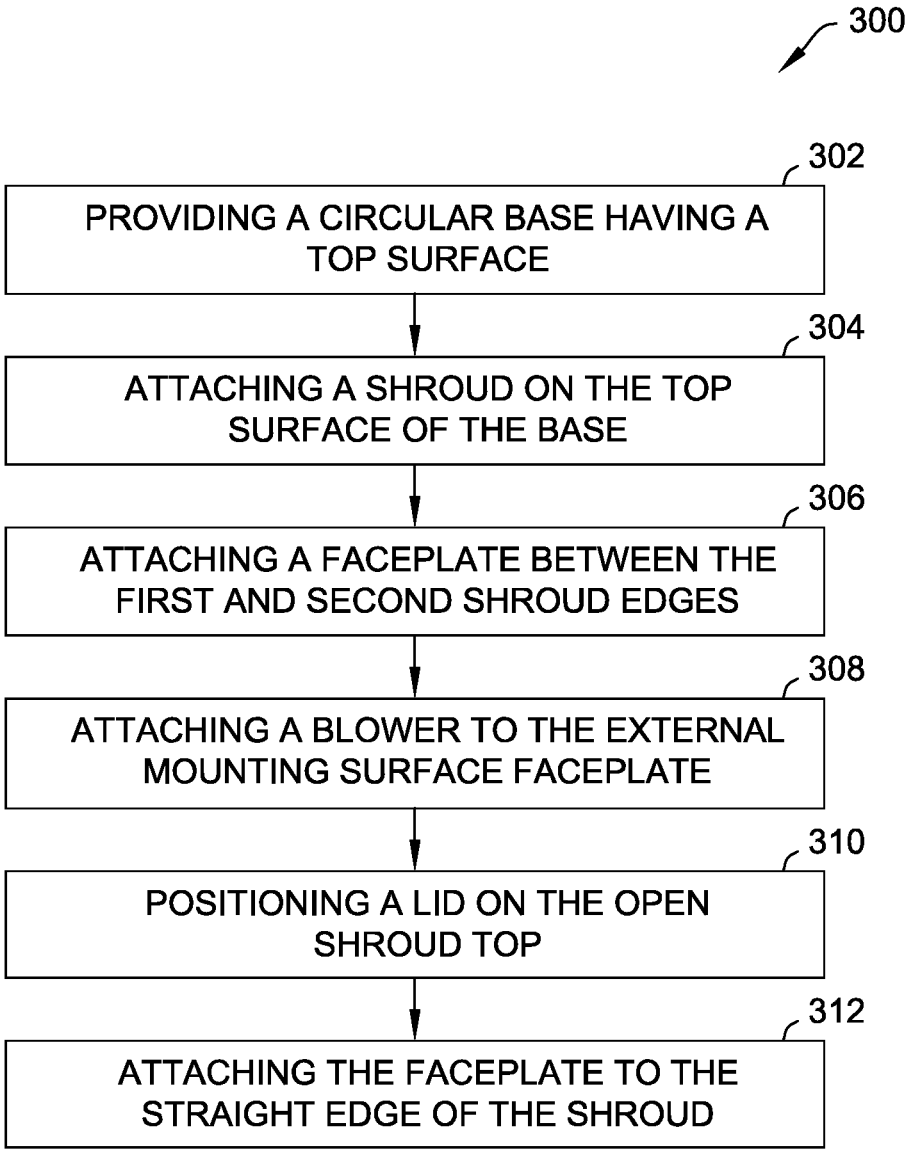
FIG. 5 illustrates a block diagram of a method of assembling an air transferring system.

FIG. 5 illustrates a block diagram of a method 300 of assembling an air transferring system. The method includes providing 302 a circular base having a top surface and attaching 304 a shroud on the top surface of the base. As previously set forth, the shroud has an open shroud top, an open shroud bottom, and an opening in the shroud defined between a first shroud edge and a second shroud edge. Furthermore, each of the shroud edges extends between the open shroud top and the shroud bottom.

The method 300 further includes attaching 306 a faceplate between the first and second shroud edges. The faceplate includes an external mounting surface and an opening. In some embodiments, the method 300 further includes attaching 308 a blower assembly to the external mounting surface faceplate. In some embodiments, the method 300 further includes positioning 310 a lid on the open shroud top. The lid has a rounded configuration and includes a straight edge. To attach 306 the faceplate, the method 300 further includes attaching 312 the faceplate to the straight edge of the shroud.

Figure 6:
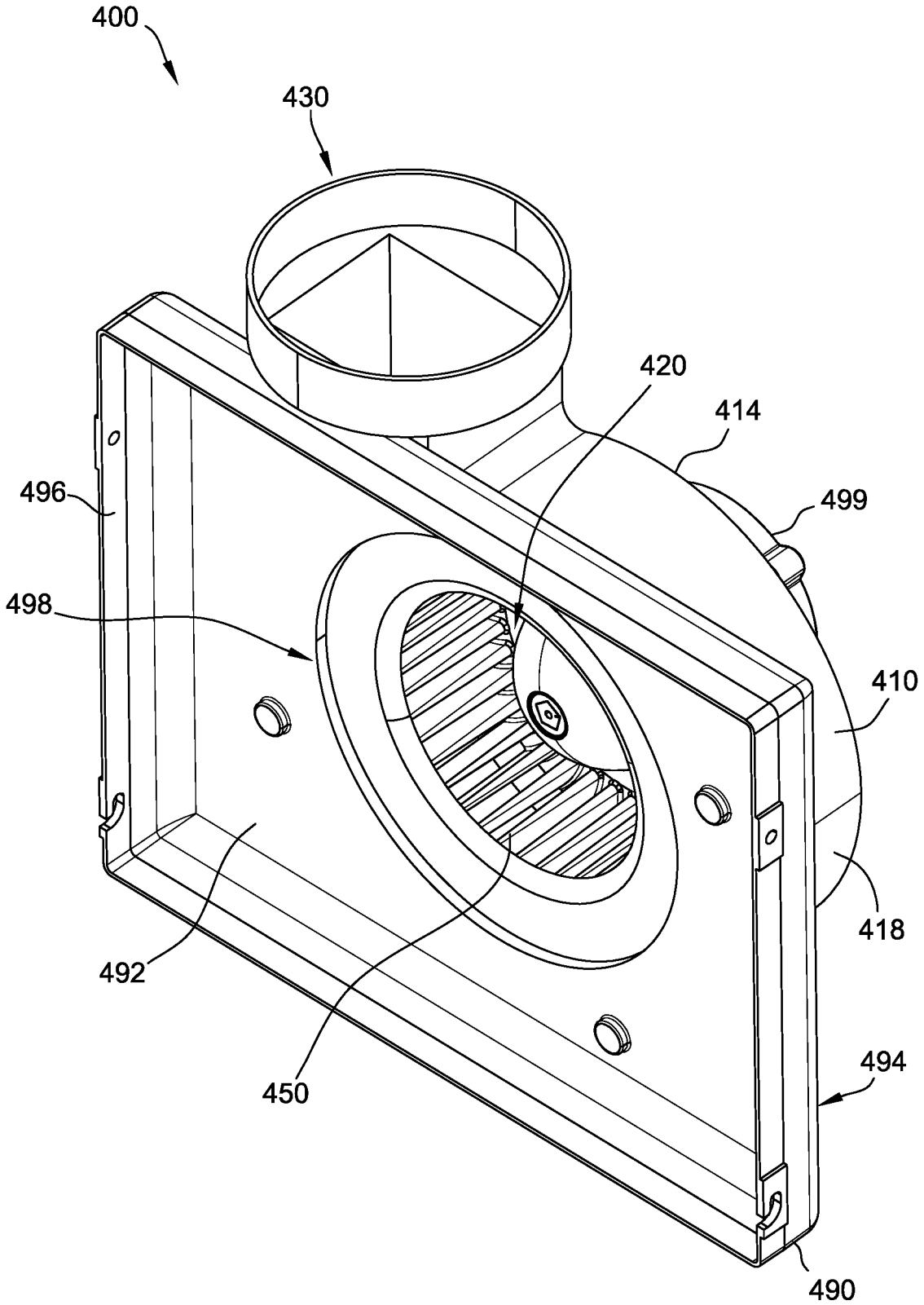
FIG. 6 illustrates a perspective view of a blower assembly and a faceplate in accordance with an embodiment of the present disclosure.
Figure 7:
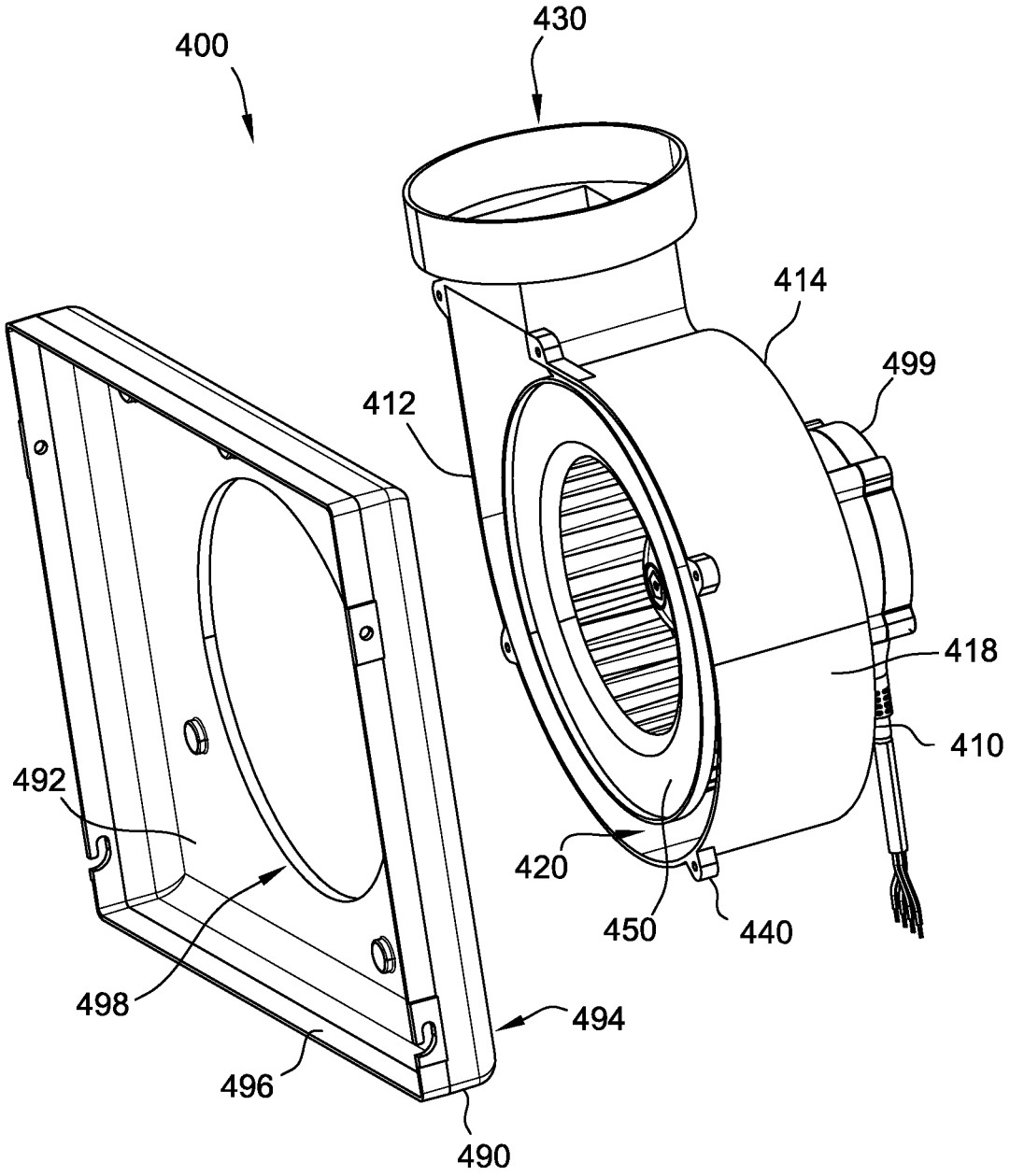
FIG. 7 illustrates an exploded view of the blower assembly shown in FIG. 6.

FIG. 6 illustrates a perspective view of a blower assembly 400 and a faceplate 490 in accordance with an embodiment of the present disclosure. The blower assembly 400 is removably attachable to the faceplate 490 similar to the blower assembly 200 and faceplate 190 of FIGS. 2-4. FIG. 7 illustrates an exploded view of the blower assembly 400 in accordance with an embodiment of the present disclosure. The faceplate 490 includes a first surface 492 and a second surface 494 opposite the first surface 492. In some embodiments, the first surface 492 includes sidewalls 496. In some embodiments, the faceplate 490 includes an air opening 498.

The blower assembly 400 includes a blower housing 410, a centrifugal impeller 450, and a motor 499. The blower housing 410 includes an open end 412 and a closed end 414 and at least one sidewall 418 extending between the open end 412 and a closed end 414. The open end 412 and the at least one sidewall 418 define a blower cavity 420. The blower cavity 420 is sized and configured to house an impeller 450. The blower cavity 420 further includes an opening through which a shaft of the motor 499 passes and couples to the impeller 450. The motor 499 is positioned on an outer surface of the at least one sidewall. A blower exhaust 430 extends from the at least one sidewall 418 and in some embodiments is substantially tangential to the at least one sidewall 418.

Similar to the blower assembly 200 of FIGS. 1-4, the blower housing 410 is removably attachable to the faceplate 490 by use of attachment members 440. The attachment members 440 extend outwardly from the open end 412 of the blower housing 410 such that the open end 412 attaches to the faceplate 490 and the blower cavity 420 is enclosed by the faceplate 490.

Figure 8:
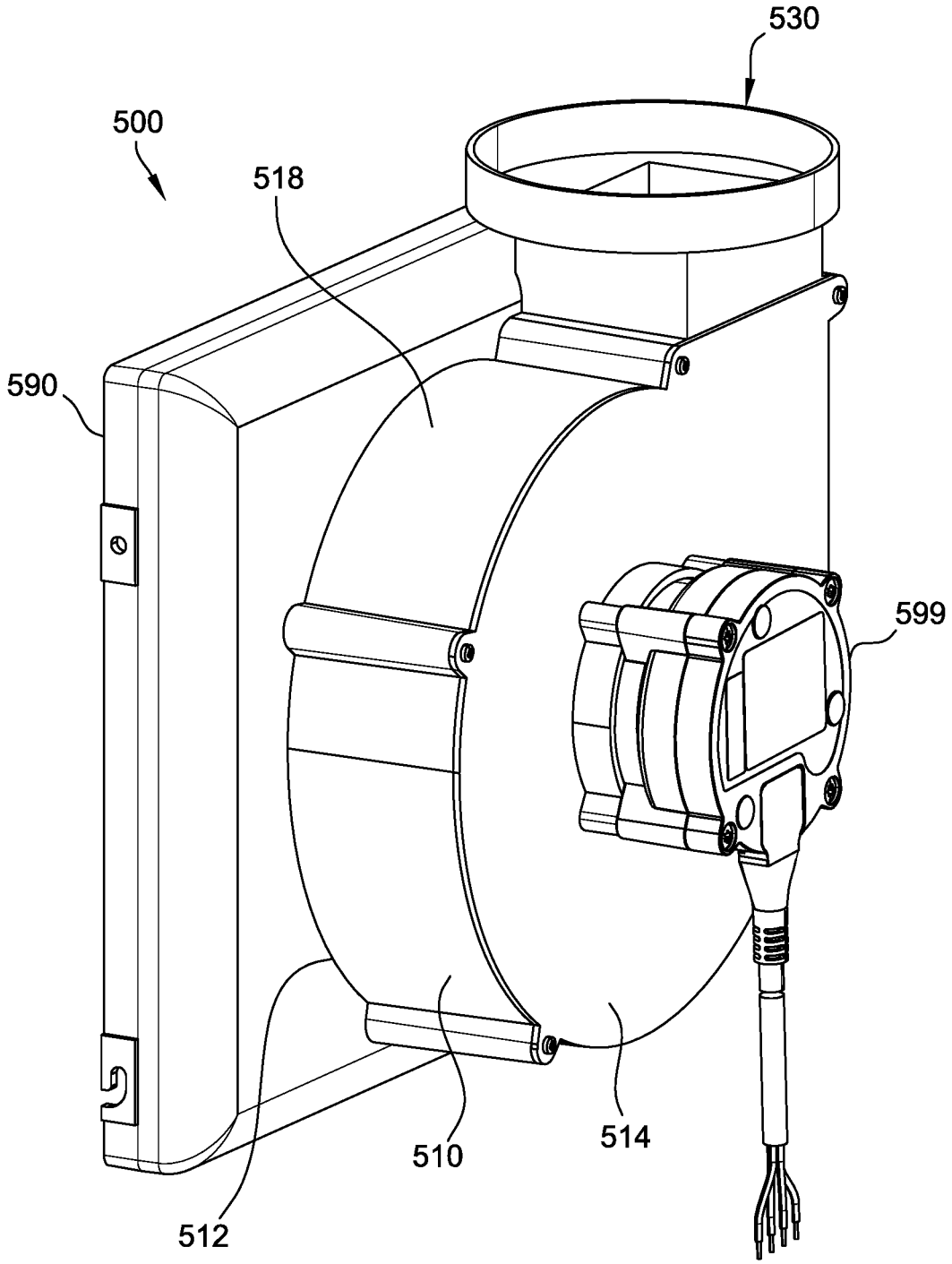
FIG. 8 illustrates a perspective view of a blower assembly and a faceplate in accordance with an embodiment of the present disclosure.
Figure 9:
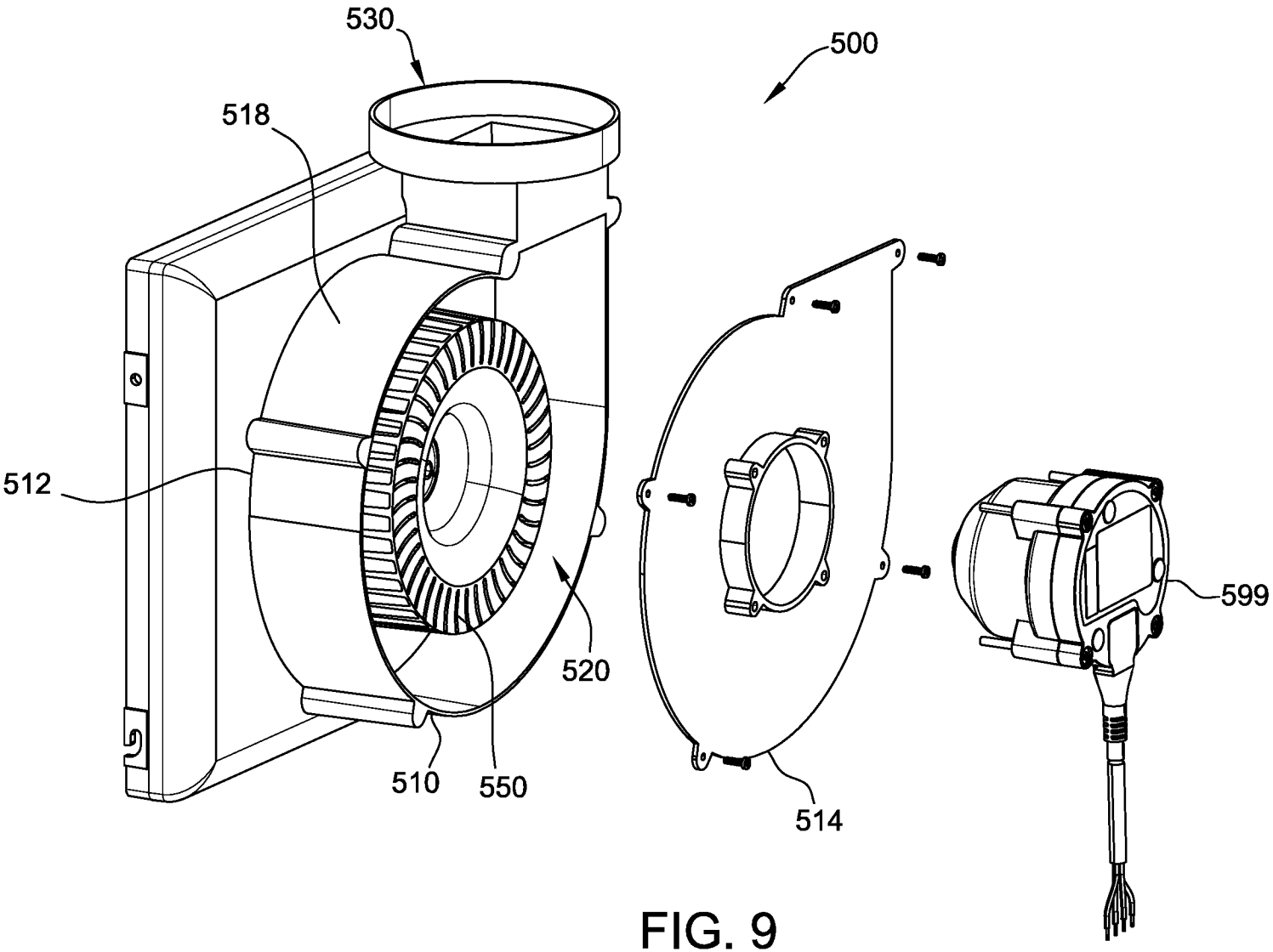
FIG. 9 illustrates an exploded view of the blower assembly shown in FIG. 8.

FIG. 8 illustrates a perspective view of a blower assembly 500 and a faceplate 590 in accordance with an embodiment of the present disclosure. The blower assembly 500 is removably attachable to the faceplate 590 similar to the blower assembly 400 and faceplate 490 of FIGS. 6-7. FIG. 9 illustrates an exploded view of the blower assembly 500 in accordance with an embodiment of the present disclosure.

Figure 10:
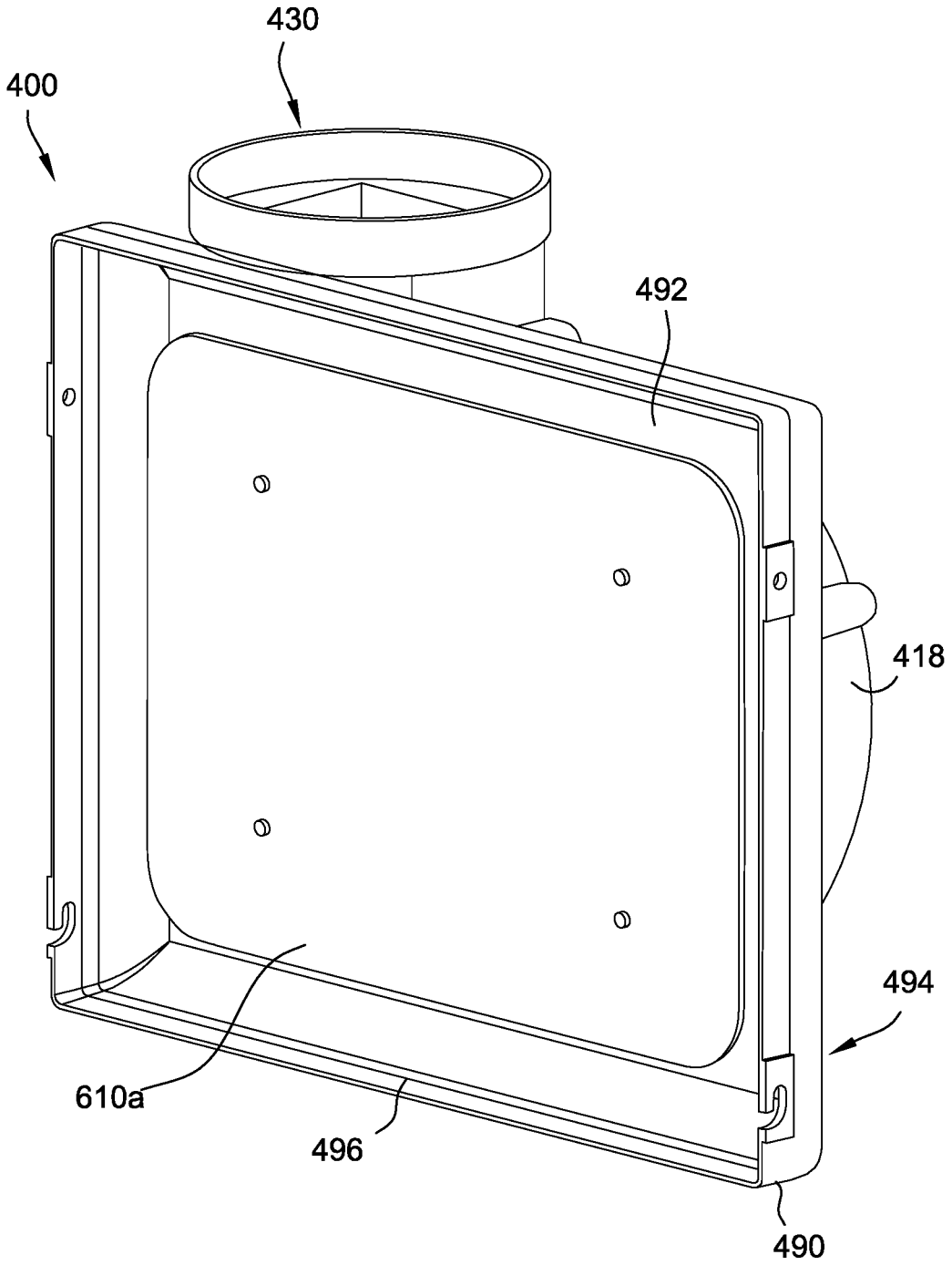
FIG. 10 illustrates the blower assembly of FIG. 6 that includes a diffuser plate proximate the blower assembly faceplate.
Figure 11:
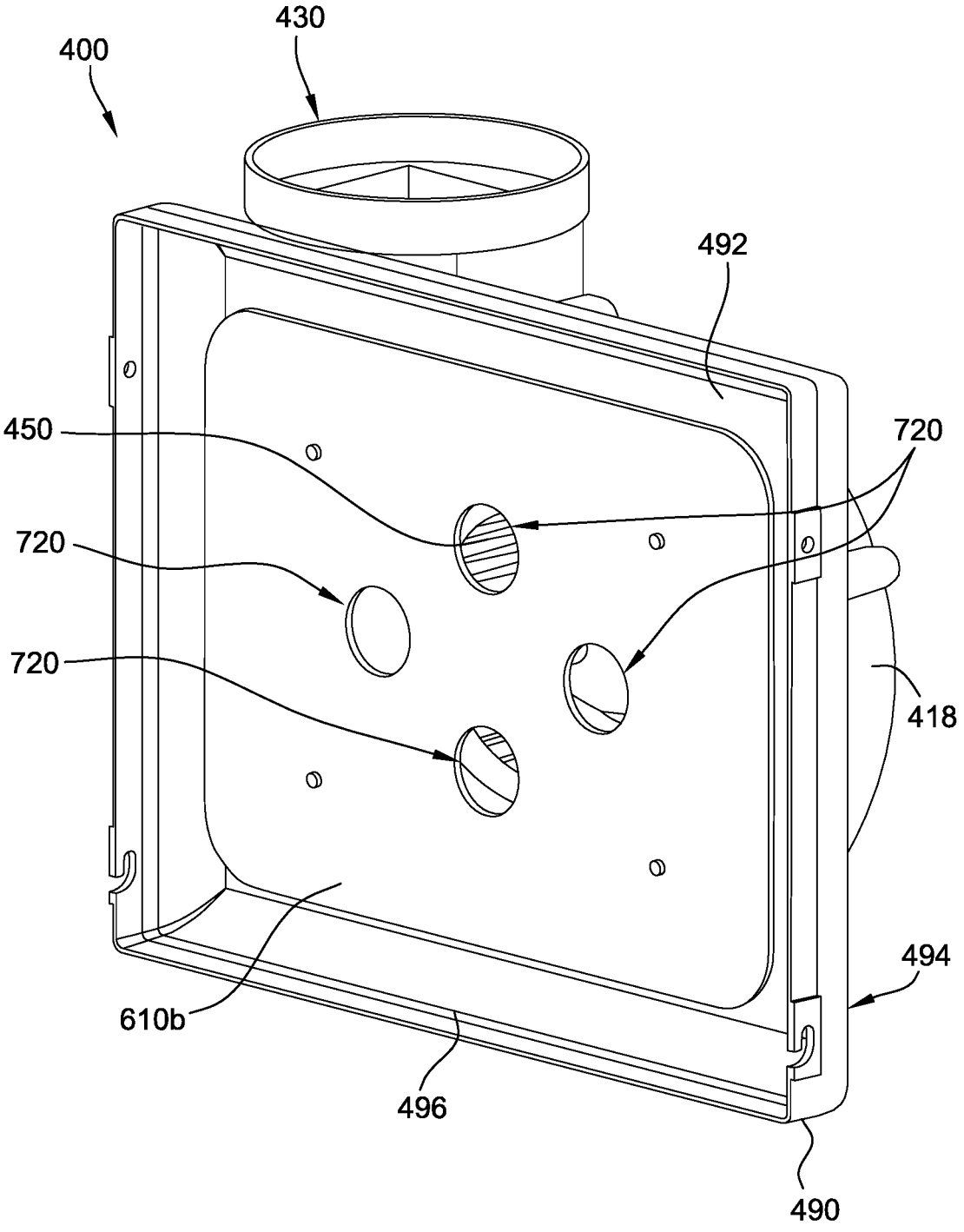
FIG. 11 illustrates the blower assembly of FIG. 10 that includes an alternate embodiment diffuser plate with centrally located diffuser plate openings; and, FIG. 12 illustrates the blower assembly of FIG. 10 that includes an alternate embodiment diffuser plate with a plurality of openings along the diffuser plate.
Figure 12:
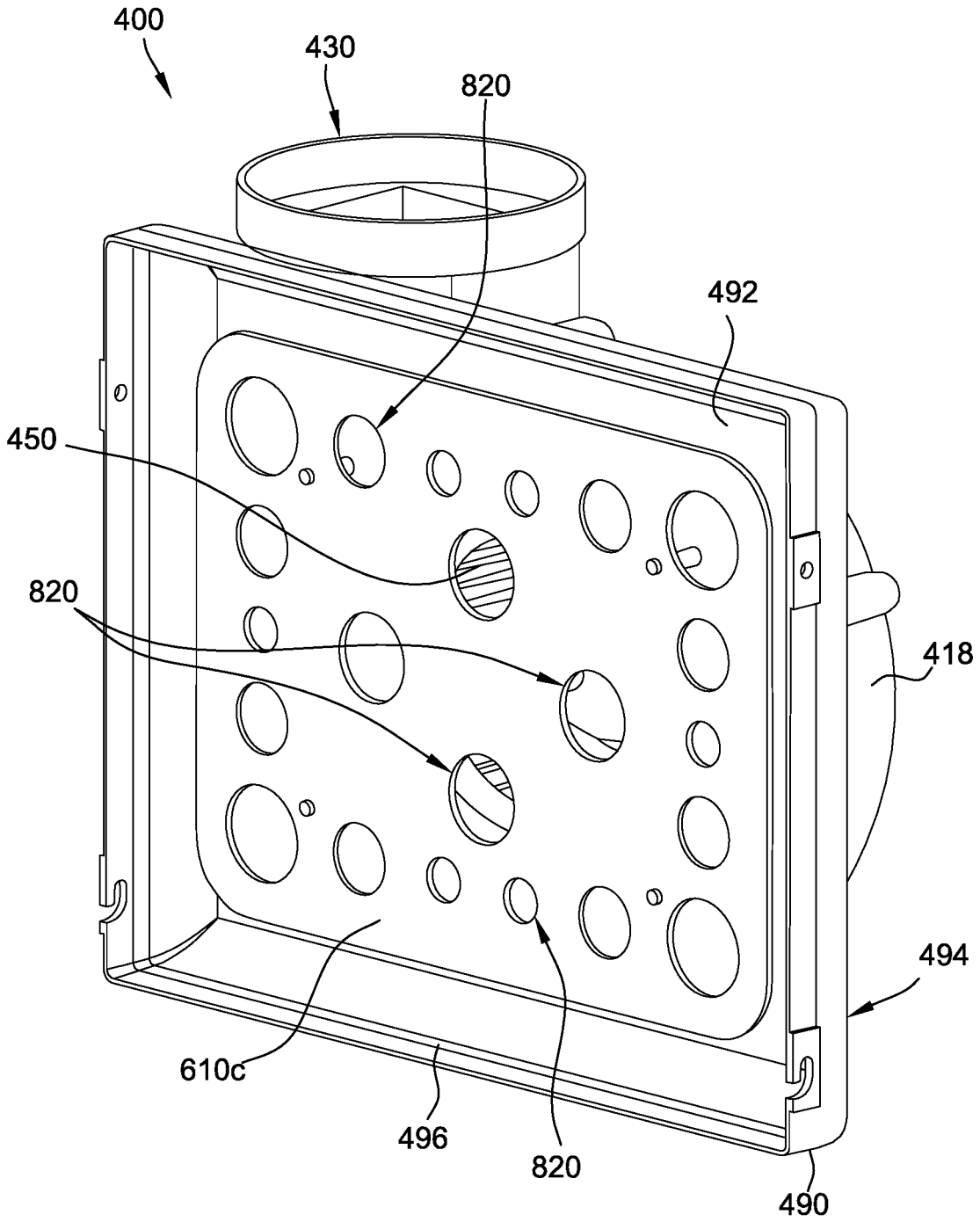

Blower assembly 400 is shown in FIGS. 10, 11, and 12. The blower assembly in each of FIGS. 10, 11 and 12 includes a respective diffuser plate 610*a*, 610*b* and 610*c*. Each of the diffuser plates 610*a*, 610*b* and 610*c* is located proximate the faceplate 492. The diffuser is separated from the faceplate by a distance. Air that is drawn into the blower assembly exits the faceplate through opening 498 and continues past the diffuser through the opening that separates the periphery of diffuser plate and the faceplate. It should be noted that although the diffuser plates 610*a*, 610*b* and 610*c* are used in combination with faceplate 492, the diffuser plates may also be used in combination with faceplate 192. The diffuser plate and faceplate may be unitary. The unitary faceplate and diffuser plate may be molded from plastic using a known manufacturing method. Alternatively, the diffuser plate and faceplate may comprise discrete members that are joined or fastened together using conventional fasteners or fastening methods.

In addition to locating the diffuser away from the faceplate to enable air to flow through the gap and past the diffuser plate, the diffuser plate may be provided with openings to increase the flow of air supplied to the heat pump heat exchanger (not shown). The diffuser plate of FIG. 10 does not include openings to enable air to flow through the diffuser plate. In use, the diffuser 610*a* limits the flow of air to the heat pump heat exchanger to the air that passes through the gap between the diffuser plate and faceplate. The diffuser plate 610*b* of FIG. 11 includes a number of openings or holes 720 located in the middle of the diffuser plate. In use, in addition to air that exits along the diffuser periphery as previously described relative to diffuser 610*a*, additional air may pass through the plurality of centrally located openings 720.

The openings or holes may be located at any location along the diffuser plate. FIG. 12 illustrates a diffuser plate 610*c* with openings 820 located in the middle of the plate as well as along its periphery. The openings 720 and 820 need not be circular nor uniform in diameter. Any number, shape, and configuration of openings can be selected to optimize air flow through the holes towards the faceplate.

The blower assembly 500 includes a blower housing 510, a centrifugal impeller 550, and a motor 599. The blower housing 510 includes an open end 512 and a removable backplate 514 and at least one sidewall 518 extending between the open end 512 and a removable backplate 514. The open end 512, the at least one sidewall 518, and the removable backplate 514 define a blower cavity 520. The blower cavity 520 is sized and configured to house an impeller 550. The blower cavity 520 further includes an opening through which a shaft of the motor 599 passes and couples to the impeller 550. The motor 599 is positioned on an outer surface of the at least one sidewall. A blower exhaust 530 extends from the at least one sidewall 518 and in some embodiments is substantially tangential to the at least one sidewall 518.

The removable backplate 514 allows for the impeller 550 and the motor 599 to be accessed and serviced without having to disassemble any other component of the enclosure 110 of FIGS. 1-4 or the blower assembly 500.

Other variations to the disclosed embodiments can be understood and effected by those skilled in the art in practicing the claimed invention, from the study of the drawings, the disclosure, and the appended claims. In the claims the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the claims.

While the invention has been illustrated and described in detail in the drawings and foregoing description, such illustration and description are to be considered illustrative or exemplary and not restrictive. It should be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they have structural elements that do not differ from the literal language of the claims or if they include equivalent structural elements with insubstantial differences from the literal languages of the claims.

What is claimed is:

1. An air transferring system comprising:

an enclosure including a base, a lid comprising a lid body comprising a bottom surface, a first portion having a rounded configuration, a second portion having a straight edge, and a peripheral sidewall surrounding the rounded configuration and a portion of the straight edge portion and extending perpendicular to the bottom surface, the lid further comprising an air conduit opening, the enclosure further including shroud having a body comprising an open shroud top, an open shroud bottom, a first shroud edge and a second shroud edge, wherein an opening in the shroud is defined between the first shroud edge and the second shroud edge, wherein each of the first shroud edge and the second shroud edge extends between the open shroud top and the open shroud bottom and are co-planar with one another, and the lid is removably attached to the open shroud top;

a faceplate comprising a faceplate opening, a first surface, and a second surface opposite the first surface, the first surface of the faceplate extending between the first shroud edge and the second shroud edge, wherein the faceplate is configured to be removably mounted to the first shroud edge, the second shroud edge and the peripheral sidewall of the lid straight edge portion; and a blower assembly attached to the faceplate, the blower assembly comprising:

a blower housing including:

a first surface positioned immediately adjacent the second surface of the faceplate;

a second surface formed opposite the first surface;

at least one sidewall extending from the second surface and defining a blower cavity; and a blower exhaust proximate to the faceplate opening, and an impeller received within the blower cavity of the blower housing, the impeller configured for drawing air through the air conduit opening, the faceplate opening, and the blower exhaust and urging the air out the blower exhaust.

2. The air transferring system of claim 1, wherein the shroud body comprises a rounded shroud body and wherein the first and second shroud edges are opposed.

3. The air transferring system of claim 1, wherein the shroud top has a rounded periphery that comprises a shroud top perimeter, and the lid peripheral sidewall surrounding the rounded configuration being substantially the same as the shroud top perimeter.

4. The air transferring system of claim 3, wherein the straight edge and the first edge and the second edge of the shroud define a mounting plane.

5. The air transferring system of claim 4, wherein the faceplate is coupled to the straight edge, first edge, and second edge along the mounting plane.

6. The air transferring system of claim 5, wherein the faceplate and the shroud in combination define an interior cavity of the enclosure.

7. The air transferring system of claim 6, wherein the blower housing of the blower assembly is external to the interior cavity of the enclosure.

8. The air transferring system of claim 1, wherein the blower cavity is formed through the first surface of the blower housing.

9. The air transferring system of claim 1, wherein the blower exhaust is defined by the at least one sidewall.

10. The air transferring system of claim 1, wherein the blower assembly further comprises a blower motor having a rotatable shaft coupled to the impeller.

11. The air transferring system of claim 10, wherein the blower motor is positioned on an outer surface of the at least one sidewall.

12. The air transferring system of claim 1, wherein the blower housing further comprises a housing base, the housing base attached to the faceplate when the blower assembly is assembled for use in the air transferring system.

13. The air transferring system of claim 1, further comprising a diffuser plate proximate the faceplate.

14. The air transferring system of claim 13, wherein the diffuser plate is located a distance from the faceplate.

15. The air transferring system of claim 14, wherein the diffuser plate includes at least one opening.

16. The air transferring system of claim 15, wherein the diffuser plate includes a plurality of openings.

17. A method of assembling an air transferring system, the method comprising: providing a circular base having a top surface; removably attaching a shroud on the top surface of the base, the shroud having an open shroud top, an open shroud bottom, and an opening in the shroud defined between a first shroud edge and a second shroud edge, each of the first shroud edge and the second shroud edge extending between the open shroud top and the open shroud bottom and being co-planar with one another; removably attaching a faceplate between the first shroud edge and the second shroud edge, the faceplate including a faceplate opening, a first surface, and a second surface opposite the first surface, wherein the first surface of the faceplate extending extends between the first shroud edge and second shroud edge; and removably attaching a blower assembly to the second surface of the faceplate, the blower assembly including: a blower housing including: a first surface positioned immediately adjacent the second surface of the faceplate; a second surface formed opposite the first surface; at least one sidewall extending from the second surface and defining a blower cavity; and a blower exhaust proximate to the faceplate opening, and an impeller received within the blower cavity of the blower housing, the impeller for drawing air through the faceplate opening and the blower exhaust and urging the air out the blower exhaust; and positioning a lid on the open shroud top, wherein the lid is removably attached to the open shroud top; the lid comprising a lid body comprising a bottom surface, a first portion having a rounded configuration, a second portion having a straight edge, and a peripheral sidewall surrounding the rounded configuration and a portion of the straight edge portion and extending perpendicular to the bottom surface, the lid further comprising an air conduit opening; wherein the faceplate is configured to be removably mounted to the first shroud edge, the second shroud edge and the peripheral sidewall of the lid straight edge portion.

18. The method of claim 17, wherein the lid has a rounded configuration and includes a straight edge, wherein the attaching of the faceplate further comprises attaching the faceplate to the straight edge.

19. The air transferring system of claim 1, wherein the blower assembly further includes a removable backplate coupled to the at least one sidewall extending from the second surface, the removable backplate further defining the blower cavity, wherein the impeller is positioned immediately adjacent the removable backplate.

* * * * *